US008820086B2

(12) United States Patent
Bailey et al.

(10) Patent No.: US 8,820,086 B2
(45) Date of Patent: Sep. 2, 2014

(54) GAS TURBINE COMBUSTOR ENDCOVER ASSEMBLY WITH INTEGRATED FLOW RESTRICTOR AND MANIFOLD SEAL

(75) Inventors: Donald Mark Bailey, Simpsonville, SC (US); Donald Timothy Lemon, Greenville, SC (US); Kwanwoo Kim, Mason, OH (US); Patrick Benedict Melton, Horse Shoe, NC (US)

(73) Assignee: General Electric Company, Schenectady, NY (US)

( * ) Notice: Subject to any disclaimer, the term of this patent is extended or adjusted under 35 U.S.C. 154(b) by 853 days.

(21) Appl. No.: 13/008,399

(22) Filed: Jan. 18, 2011

(65) Prior Publication Data

US 2012/0180488 A1 Jul. 19, 2012

(51) Int. Cl.
*F02C 1/00* (2006.01)

(52) U.S. Cl.
USPC ..... 60/734; 60/739; 60/740

(58) Field of Classification Search
USPC ..... 60/740, 734, 739, 752, 756
See application file for complete search history.

(56) References Cited

U.S. PATENT DOCUMENTS

| | | | | |
|---|---|---|---|---|
| 5,269,468 | A * | 12/1993 | Adiutori | 239/397.5 |
| 6,755,024 | B1 * | 6/2004 | Mao et al. | 60/776 |
| 6,763,663 | B2 * | 7/2004 | Mansour et al. | 60/740 |
| 6,883,329 | B1 * | 4/2005 | Martling | 60/746 |
| 7,134,287 | B2 | 11/2006 | Belsom et al. | |
| 8,464,539 | B2 * | 6/2013 | Pelletier et al. | 60/742 |
| 2003/0010033 | A1 * | 1/2003 | Mansour et al. | 60/740 |
| 2005/0005610 | A1 | 1/2005 | Belsom et al. | |
| 2006/0000218 | A1 * | 1/2006 | Dinu et al. | 60/737 |
| 2006/0010873 | A1 * | 1/2006 | Henriquez | 60/752 |
| 2007/0151255 | A1 | 7/2007 | Johnson et al. | |
| 2009/0277177 | A1 * | 11/2009 | Hessler | 60/740 |
| 2010/0132363 | A1 * | 6/2010 | DesChamps et al. | 60/740 |

* cited by examiner

*Primary Examiner* — Gerald L Sung
(74) *Attorney, Agent, or Firm* — Nixon & Vanderhye P.C.

(57) ABSTRACT

An endcover assembly for a turbine combustor adapted to support one or more combustor nozzles includes a substantially flat plate having one side which in use, faces a combustion chamber and an opposite side which, in use, faces away from the combustion chamber. At least one fuel passage extends through the substantially flat plate. A fuel manifold porting block is secured to the opposite side of the flat plate with at least one port aligned with the at least one passage. A fuel restrictor insert formed with multiple flow orifices is located between the flat plate and the fuel manifold porting block in alignment with the at least one fuel passage and the at least one port.

20 Claims, 4 Drawing Sheets

GAS TURBINE COMBUSTOR ENDCOVER ASSEMBLY WITH INTEGRATED FLOW RESTRICTOR AND MANIFOLD SEAL

BACKGROUND OF THE INVENTION

This invention relates to gas turbine combustors generally, and more specifically, to a novel endcover assembly for the forward or upstream end of a gas turbine combustor.

In certain gas turbines, a plurality of combustors are arranged in an annular array about the turbine rotor to provide for the combustion of fuel and guide the energized combustion products into the turbine section to drive the turbine. Each combustor typically includes an outer casing which defines the external boundary of the combustor, a flow sleeve for distributing compressor discharge air to the head of the combustion system while also cooling a liner which encloses the combustion process, and a transition piece for flowing the combustion products into the turbine section. The combustor also includes a plurality of fuel nozzles coupled to an endcover. Air and fuel is supplied through the endcover to the fuel nozzles for combustion within the liner. The endcover thus functions to close the combustor forward end and to distribute air and fuel to the fuel nozzles.

Endcover designs for turbine combustor systems typically have included a flat plate mounting each fuel nozzle individually. In prior endcover assemblies of this type, the internal passages for the air and fuel were located in the fuel nozzle separate and apart from the endcover. A follow-on generation of endcovers provided air and fuel passages internal to the endcover. This was done to accommodate a plurality of nozzles for each endcover rather than one fuel nozzle per endcover as in prior conventional combustors. While that change simplified the fuel nozzles and enabled the mounting of a plurality of fuel nozzles onto the endcover, the complexity of the endcover was increased to provide the air and fuel manifolds and necessary multiple passages internal to the endcover for the fuel nozzles carried thereby. Extra parts were necessary, such as inserts, to render complex passages in the endcovers possible. Brazed joints were also included to seal such extra parts, including inserts in the endcovers. A further generation of endcovers for turbine combustors followed. These employed even more complicated brazed joints between the endcovers and their various parts. However, cracking of the brazed joints was observed on these follow-on endcovers.

Certain prior endcover assemblies require gas flow orifices (also referred to herein as "flow restrictors", or "flow restrictor inserts") to be pressed and staked into place on the "hot side" of the combustor endcover plate (that side exposed to combustion in the combustion chamber).

There remains a need for an endcover assembly which simplifies endcover constructions and the insertion of flow restrictors, and which also provides other desirable features including sealing to prevent leakage past the flow restrictor inserts.

BRIEF DESCRIPTION OF THE INVENTION

This invention relates primarily to the use of, and assembly techniques for, fuel restrictor inserts and related sealing in combustor endcover assemblies.

In a first exemplary embodiment of the invention provides an endcover assembly for a turbine combustor adapted to support one or more combustor nozzles, the endcover assembly comprising a substantially flat plate having one side which in use, faces a combustion chamber and an opposite side which, in use, faces away from the combustion chamber; at least one fuel passage extending through the substantially flat plate; a fuel manifold porting block secured to the opposite side of the flat plate with at least one port aligned with the at least one passage; and a fuel restrictor insert formed with multiple flow orifices located between the flat plate and the fuel manifold porting block in alignment with said at least one fuel passage and the at least one port.

In another exemplary embodiment, the invention provides an endcover assembly for a turbine combustor adapted to support one or more combustor nozzles, the endcover assembly comprising a substantially flat endcover plate having one side which in use, faces a combustion chamber and an opposite side which, in use, faces away from the combustion chamber; plural premix fuel passages extending through the substantially flat endcover plate; a fuel manifold porting block secured to the opposite side of the substantially flat endcover plate, with a port connecting to each of the plural passages; and a fuel restrictor insert formed with multiple flow orifices secured to the fuel manifold porting block at the interface between each premix fuel passage in the endcover plate and each port in the fuel manifold porting block.

In still another exemplary embodiment, the invention provides a manifold porting block for use with an endcover of a turbine combustor adapted to support one or more combustor nozzles, the manifold porting block comprising plural fuel passages adapted to align with passages in the endcover plate, wherein a fuel restrictor insert formed with multiple flow orifices is secured to the fuel manifold porting block on a side adapted to interface with the endcover plate.

The invention will now be described in connection with the drawings identified below.

DETAILED DESCRIPTION OF THE INVENTION

Figure 1:
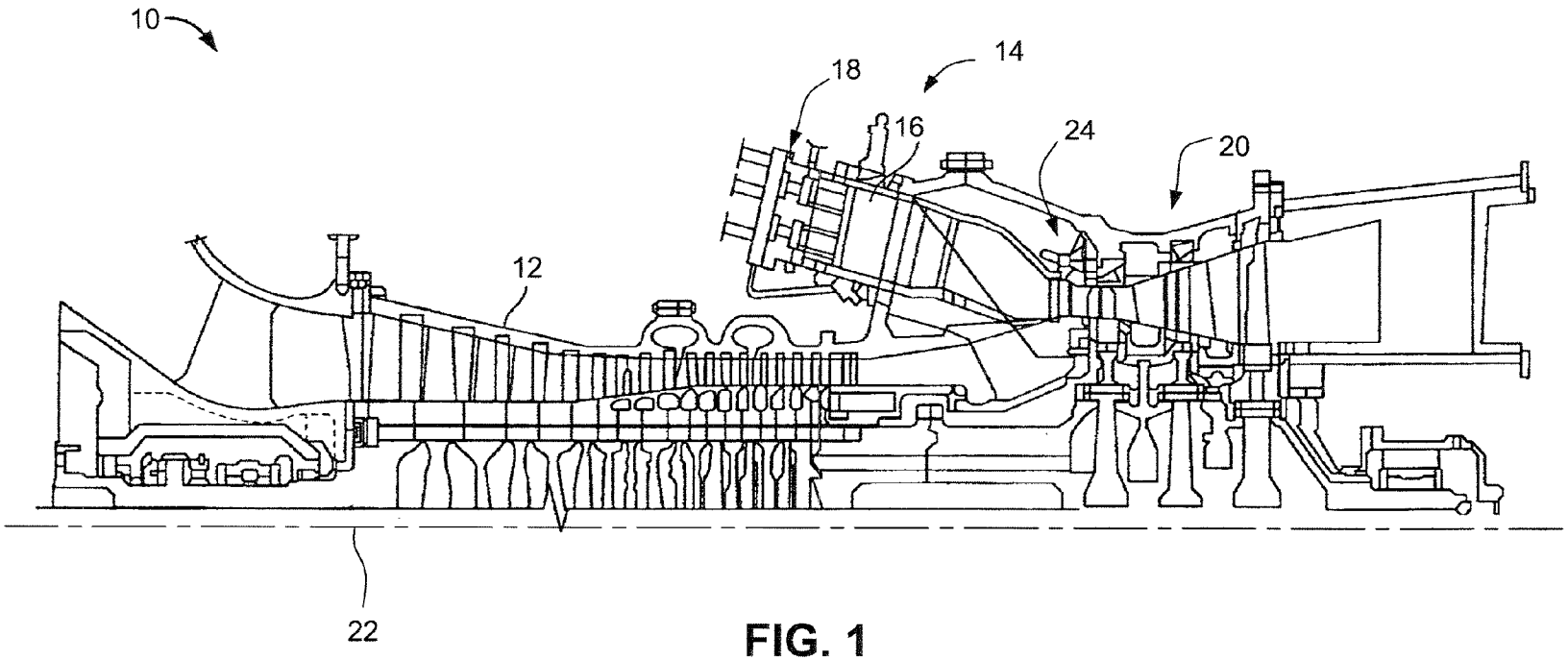
FIG. 1 is a schematic illustration of a turbine incorporating a prior combustor endcover assembly.

FIG. 1 is a schematic illustration of an exemplary combustion turbine engine 10. Engine 10 includes a compressor 12 and a combustor 14. Combustor 14 includes a combustion region 16 and a fuel nozzle assembly 18. Engine 10 also includes a turbine 20 and a common compressor/turbine shaft (sometimes referred to as rotor) indicated by the axis 22. In certain turbine engines, there is a plurality of combustors 14 arranged in an annular array about the turbine rotor, all of which supply combustion gases to the turbine first stage 24.

In operation, air flows through compressor 12 and compressed air is supplied to combustor 14. Specifically, a substantial amount of the compressed air is supplied to fuel nozzle assembly 18 secured to the head end of the combustor 14. Fuel nozzle assembly 18 channels fuel and air to combustion region 16 where the fuel/air is ignited. Combustion gases are supplied to the turbine 20 where the gas stream thermal energy is converted to mechanical rotational energy.

Figure 2:
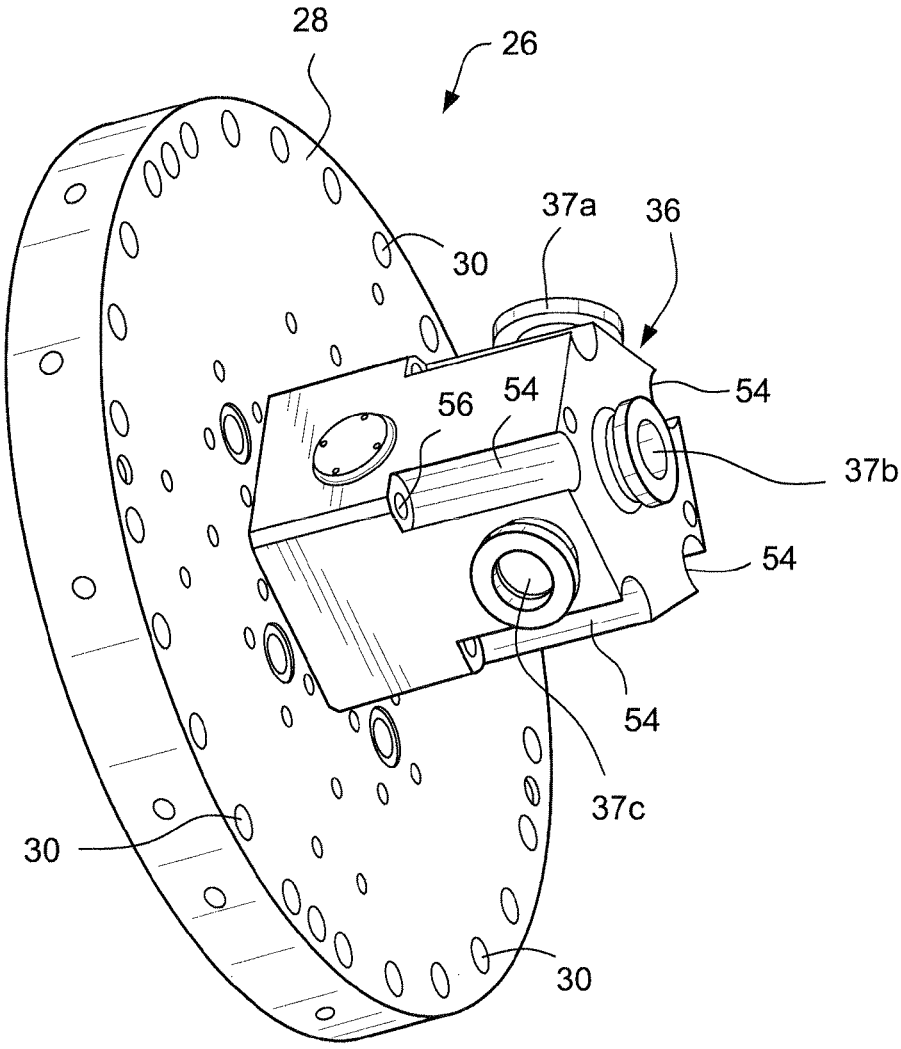
FIG. 2 is a perspective view of an endcover assembly in accordance with an exemplary but nonlimiting embodiment of the invention.
Figure 3:
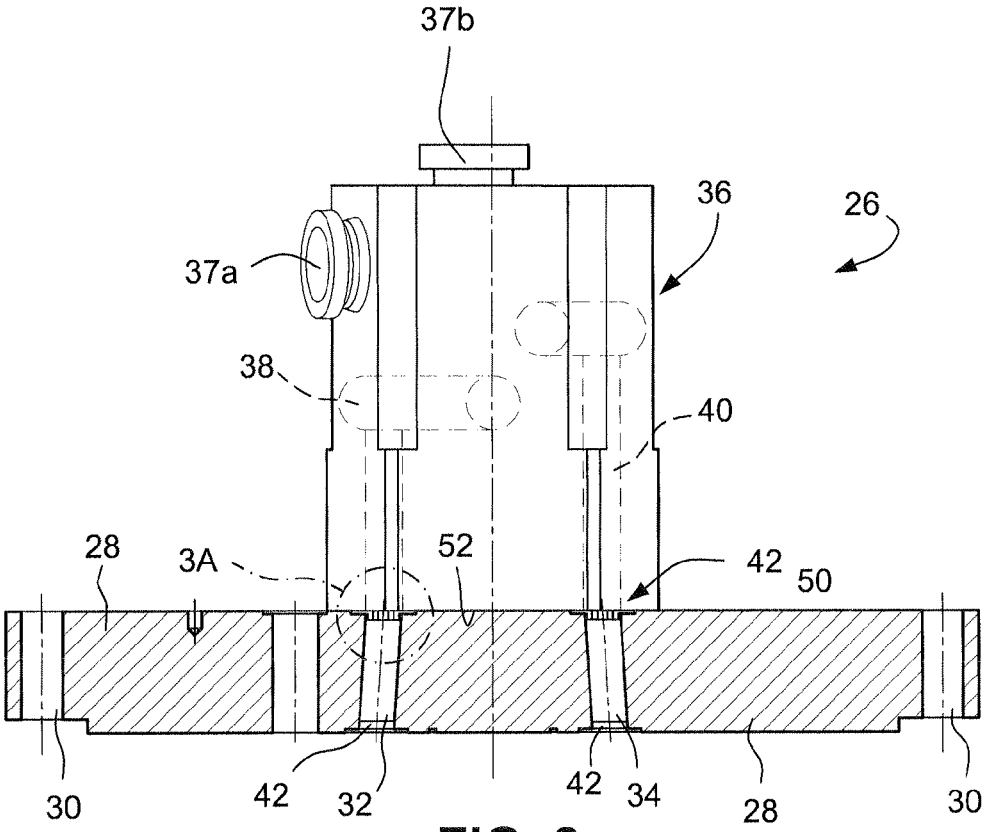
FIG. 3 is side elevation, partly in section, of the endcover assembly of FIG. 2.
Figure 3A:
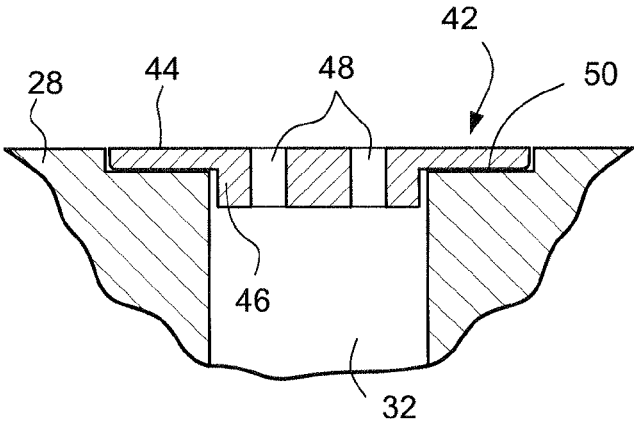
FIG. 3A is a side section of a fuel restrictor insert removed from FIG. 3.

FIGS. 2, 3 and 3A illustrate a new endcover assembly and flow restrictor design in accordance with a first exemplary but nonlimiting embodiment of the invention. The endcover assembly 26 is shown in include an endcover plate 28 provided with an array of holes 30 by which the plate is mounted at the head end of the combustor. The endcover plate 28 is also formed with internal passages 32, 34 (FIG. 3) through which premixed fuel is supplied to the combustor nozzles. While only two internal passages are shown, it will be appreciated that the number of internal passages is application specific. In one example, there are six internal passages supplying premixed fuel to five radially outer nozzles and a single center nozzle. A fuel manifold porting block 36 is secured to the cold side of the endcover plate 28 (i.e., that side external of, and facing away from, the combustion chamber) by any suitable means such as bolts or other fasteners. The block 36 is provided with plural passageways or ports (two illustrated at 38, 40) adapted for alignment with the passages 32 and 34 in the endcover plate. Pipes or other conduits (not shown) connect to the fuel manifold porting block 36 at ports 37*a, b* and *c* to supply the premixed fuel to the nozzles supported on the "hot side" of the endcover plate 28.

At the interface between the fuel manifold porting block 36 and the endcover plate 28 (on the cold side of the endcover plate), there are fuel orifices or flow restrictor inserts 42 that are seated in the endcover plate. With reference especially to FIG. 3A, each fuel restrictor insert 42 is formed with a flange 44 projecting outwardly from a center region 46 in which the fuel flow holes or orifices 48 are formed. The number of fuel holes or orifices 48 may vary but must meet an effective-fuel-area requirement as understood by those skilled in the art. In representative examples, four or five fuel orifices 48 are formed in the fuel restrictors. The center region 46 has a greater thickness than the surrounding flange 44, and is sized to fit relatively loosely within the bore of the passages 32, 34, with the radial flange 44 seated in a shallow counterbore 50 formed in the endcover plate 28, such that the radial flange 44 lies flush with, and provides a seal surface between the endcover plate 28 and the substantially flat surface 52 of the fuel manifold porting block 36. It will be appreciated that when the fuel manifold porting block 36 is bolted to the endcover plate 28 (via, for example, bolts passing through bolt slots 54 and bolt holes 56), the clamping force applied via the bolts holds the flow restrictor insert 42 in place, so that the flange 44 forms an effective seal between the fuel manifold porting block 36 and the endcover plate 28 so that no premixed fuel escapes around the flow restrictor insert.

Figure 4:
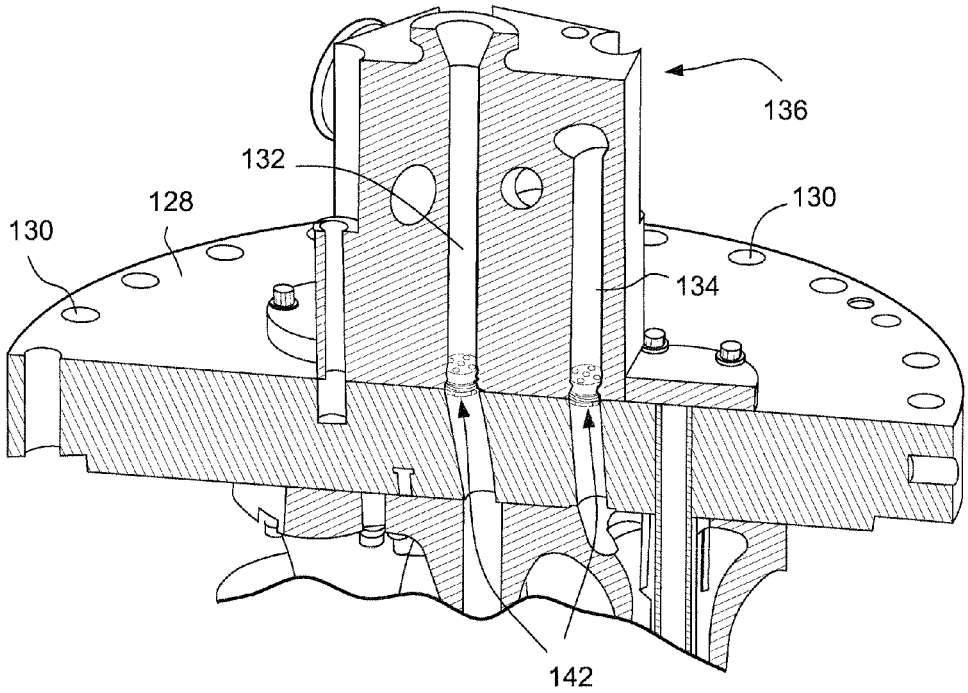
FIG. 4 is a perspective view, partly in section, of a combustor endcover assembly in accordance with another exemplary but nonlimiting embodiment of the invention.
Figure 4A:
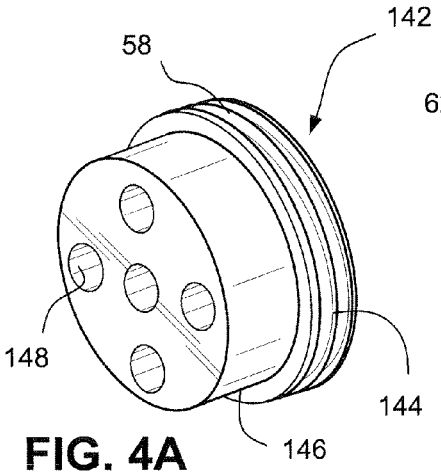
FIG. 4A is a perspective view of a fuel restrictor insert removed from FIG. 4.
Figure 5:
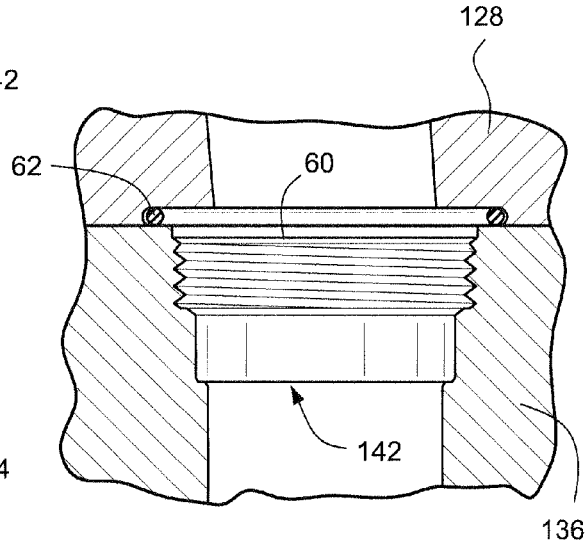
FIG. 5 is an enlarged section detail taken from FIG. 4.

Turning to FIGS. 4 and 4A, a second exemplary but nonlimiting embodiment utilizes a substantially similar endcover plate 128 and fuel manifold porting block 136, modified to accommodate flow restrictor inserts 142 attached directly to the fuel manifold porting block 136 at the interface with the cold side of the endcover plate 128. Note that reference numerals used in FIGS. 4 and 4A correspond to those used to designate corresponding elements in FIGS. 3 and 3A, but with the prefix "1" added.

Specifically, the fuel manifold porting block 136 is bolted to an endcover plate 128 in the same manner as described above. In this embodiment, however, the several flow restrictor inserts 142 are each formed to include a body portion 146 with external threads 58 providing on a radial flange 144 that projects radially only a small amount from the body portion. This arrangement enables the flow restrictors to be threaded into complimentary-threaded ends of the passages 132, 134 in the manifold porting block 136. The head 60 of the insert 142 lies just below the surface 152 of the porting block so that, after assembly, the remaining exposed female thread can be staked to prevent the insert 142 from "backing out" of the porting block 136. An aligned counterbore in the end cover plate 128 receives a seal 62 which seals between the endcover plate 128 and the porting block 136 upon assembly via the assembly bolts as described above but not shown here. The number and arrangement of the fuel holes or orifices in the flow restrictor inserts 142 remain variable as previously described.

The fuel restrictor inserts 42, 142 may be made of a suitable metal material such as brass or stainless steel, with or without plating such as silver, gold or aluminum that enhances the sealing characteristics. Alternatively or in combination, an elastomeric material may be added to the composition to further enhance the sealing function.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An endcover assembly for a turbine combustor adapted to support one or more combustor nozzles, the endcover assembly comprising:

a substantially flat plate having one side which in use, faces a combustion chamber and an opposite side which, in use, faces away from the combustion chamber; at least one fuel passage extending through said substantially flat plate; a fuel manifold porting block secured to said opposite side of said flat plate with at least one port aligned with said at least one passage; and a fuel restrictor insert formed with multiple flow orifices located between said flat plate and said fuel manifold porting block in alignment with said at least one fuel passage and said at least one port.

2. The endcover assembly of claim 1 wherein said one or more passages comprises at least six passages.

3. The endcover assembly of claim 1 wherein each said passage is formed with a shallow counterbore surrounding a respective passage, and wherein said fuel restrictor insert is formed with a peripheral flange seated in said shallow counterbore and a center region seated in one of said one or more passages.

4. The endcover assembly of claim 3 wherein said peripheral flange is substantially flush with said opposite side.

5. The endcover assembly of claim 3 wherein said multiple flow orifices 48 comprise at least four passages formed in said center region.

6. The endcover assembly of claim 1 wherein said fuel restrictor insert is threaded into said at least one port in said fuel manifold porting block.

7. The endcover assembly of claim 6 wherein a seal is seated in an aligned counterbore in said substantially flat plate surrounding said fuel restrictor insert and engaged between substantially flat plate and said manifold porting block when the fuel manifold is secured to the endcover plate.

8. The endcover assembly of claim 1 wherein said fuel restrictor insert is constructed of a plated-metal material.

9. The endcover assembly of claim 1 wherein said fuel restrictor insert is plated with gold, silver or aluminum.

10. An endcover assembly for a turbine combustor adapted to support one or more combustor nozzles, the endcover assembly comprising:

a substantially flat endcover plate having one side which in use, faces a combustion chamber and an opposite side which, in use, faces away from the combustion chamber; plural premix fuel passages extending through said substantially flat endcover plate; a fuel manifold porting block secured to said opposite side of said substantially flat endcover plate, with a port connecting to each of said plural passages; and a fuel restrictor insert formed with multiple flow orifices secured to said fuel manifold porting block at the interface between each premix fuel passage in said endcover plate and each port in said fuel manifold porting block.

11. The endcover assembly of claim 10 wherein a seal is seated in an aligned counterbore in said substantially flat plate surrounding said fuel restrictor insert and engaged between substantially flat plate and said manifold porting block when said manifold porting block is secured to the endcover plate.

12. The endcover assembly of claim 10 wherein said fuel restrictor insert is threaded into said fuel manifold porting block.

13. The endcover assembly of claim 10 wherein said fuel restrictor insert is constructed of a plated metal material.

14. The endcover assembly of claim 13 wherein said fuel restrictor insert is plated with gold, silver or aluminum.

15. The endcover assembly of claim 10 wherein said fuel manifold porting block is bolted to said endcover plate.

16. A manifold porting block for use with an endcover of a turbine combustor adapted to support one or more combustor nozzles, the manifold porting block comprising:

a mounting surface configured to abut against a surface of the endcover within the combustor;

fuel passages adapted to align with passages in the endcover plate; and a fuel restrictor insert with multiple flow orifices is aligned with one of the fuel passages, the fuel restrictor insert is secured to said fuel manifold porting block and the fuel restrictor insert is proximate to the mounting surface.

17. The manifold porting block of claim 16 wherein said fuel restrictor insert is threaded into the one of the fuel passages of said fuel manifold porting block.

18. The manifold porting block of claim 16 wherein said fuel restrictor insert includes a plated metal material.

19. The manifold porting block of claim 16 wherein said fuel restrictor insert is plated with gold, silver or aluminum.

20. The manifold porting block of claim 16 wherein said fuel restrictor insert is formed with four or more fuel orifices.

* * * * *